United States Patent [19]

Tahara

[11] Patent Number: 5,063,006

[45] Date of Patent: Nov. 5, 1991

[54] METHODS FOR REPAIRING CRACKS IN CONCRETE STRUCTURES

[75] Inventor: Tetsuo Tahara, Onojo, Japan

[73] Assignee: Shinnihon Jushikako Co., Ltd., Fukuoka, Japan

[21] Appl. No.: 658,459

[22] Filed: Feb. 22, 1991

Related U.S. Application Data

[63] Continuation of Ser. No. 529,729, May 29, 1990, abandoned, which is a continuation of Ser. No. 216,377, Jul. 8, 1988, abandoned.

[30] Foreign Application Priority Data

| | | | |
|---|---|---|---|
| Jul. 13, 1987 | [JP] | Japan | 62-175723 |
| Oct. 1, 1987 | [JP] | Japan | 62-249358 |
| Oct. 1, 1987 | [JP] | Japan | 62-249359 |

[51] Int. Cl.[5] ..... B29C 31/04; B32B 35/00; E02D 37/00; E04G 23/02

[52] U.S. Cl. ..... 264/35; 264/36; 52/514; 52/743; 404/75; 425/13; 427/150

[58] Field of Search ..... 264/36, 31–35; 52/514, 743; 425/11–13; 428/63; 427/140; 405/150; 156/94; 404/75, 82

[56] References Cited

U.S. PATENT DOCUMENTS

| | | | |
|---|---|---|---|
| 1,883,196 | 10/1932 | Wertz | 264/36 |
| 1,905,405 | 4/1933 | Winslow | 52/514 |
| 1,953,452 | 4/1934 | Wertz | 264/36 |
| 2,313,110 | 3/1943 | Wertz | 264/36 |
| 2,524,419 | 10/1950 | Billner | 264/36 |
| 3,102,829 | 9/1963 | Rathbun, Jr. | 118/410 |
| 3,202,732 | 8/1965 | Braun et al. | 264/36 X |
| 4,060,953 | 12/1977 | Milne | 264/36 X |
| 4,086,309 | 4/1978 | Alberts | 264/36 X |
| 4,240,995 | 12/1980 | Milne | 264/36 |
| 4,352,262 | 10/1982 | Edelmann et al. | 52/514 X |
| 4,360,994 | 11/1982 | Hodges | 264/36 X |
| 4,465,648 | 8/1984 | Kiriyama et al. | 264/36 X |
| 4,555,286 | 11/1985 | Orikasa et al. | 264/36 X |
| 4,622,085 | 11/1986 | Yamada et al. | 264/36 X |
| 4,714,507 | 12/1987 | Ohgushi | 264/36 X |
| 4,793,162 | 12/1988 | Emmons | 52/514 X |
| 4,861,401 | 8/1989 | Miura et al. | 264/36 X |

FOREIGN PATENT DOCUMENTS

| | | | |
|---|---|---|---|
| 0036397 | 9/1983 | European Pat. Off. . | |
| 0169170 | 1/1986 | European Pat. Off. . | |
| 3620490 | 12/1987 | Fed. Rep. of Germany | 264/36 |
| 598524 | 12/1925 | France . | |
| 2255272 | 7/1975 | France . | |
| 419560 | 3/1967 | Switzerland | 52/514 |

*Primary Examiner*—Jan H. Silbaugh
*Assistant Examiner*—Karen Aftergut
*Attorney, Agent, or Firm*—Burns, Doane, Swecker & Mathis

[57] ABSTRACT

Cracks in concrete structures are repaired by attaching over the crack a series of cutoff agent-sealing members having a predetermined open area and volume necessary for filling the crack. A blowing resin is introduced under pressure into internal chambers of the cutoff agent-sealing members to elevate the pressure within the cutoff agent-sealing members. Inlet and outlet valves of the chambers are closed, whereupon the elevated pressure causes the cutoff agent to intrude deeply into the interior of the crack, whereby an inundation and leakage of water from the crack can be prevented.

7 Claims, 9 Drawing Sheets

Fig. 5a
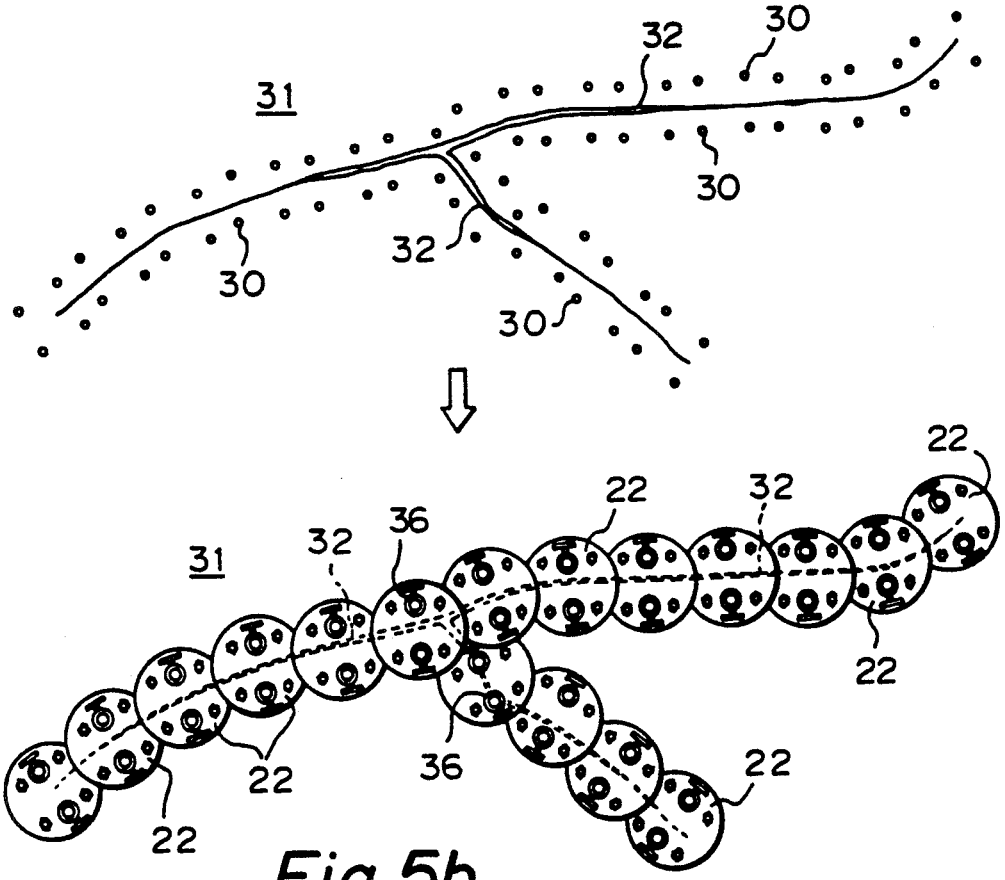
Fig. 5b
Fig. 6
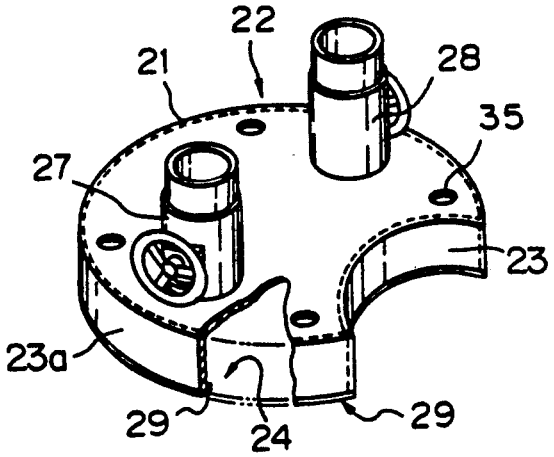

Fig. 8a
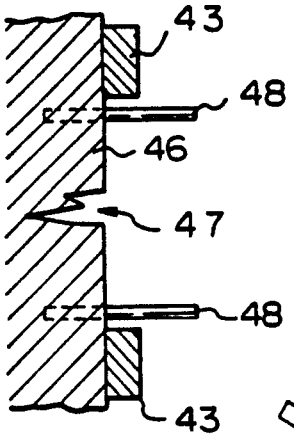
Fig. 8b
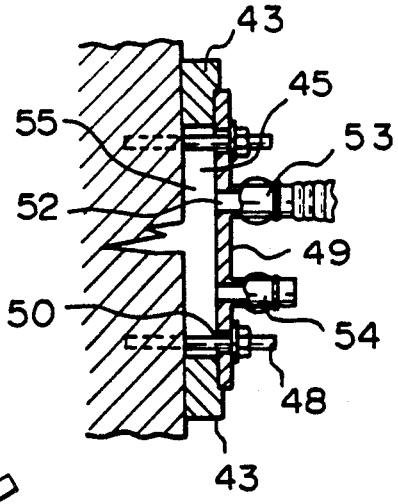
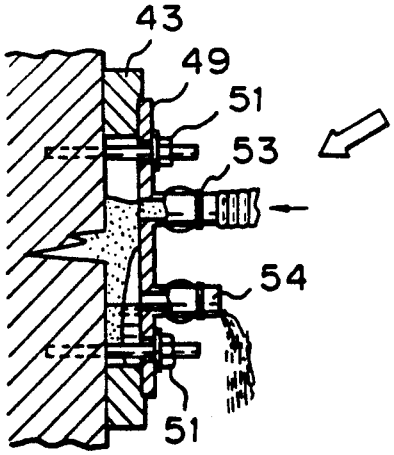
Fig. 8c
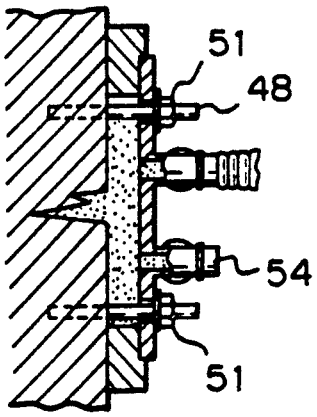
Fig. 8d

METHODS FOR REPAIRING CRACKS IN CONCRETE STRUCTURES

This application is a continuation of application Ser. No. 07/529,729, filed May 29, 1990, which is a continuation application of Ser. No. 07/216,377, filed July 8, 1988, both now abandoned.

BACKGROUND OF THE INVENTION (1) Field of the Invention

The present invention relates to a method for preventing an inundation or a leakage of water from cracks formed in a concrete structure such as a tunnel, a basement, a dam, a weir, a swimming pool or an outdoor concrete structure, and a device for working this cutoff method.

(2) Description of the Related Art

As the conventional method for preventing an inundation or a leakage of water from cracks of a concrete structure, a method has been adopted in which a V-shaped notch is formed on the surface portion of a cracked concrete structure, a resin-casting tube is inserted in the V-shaped notch, a quick-setting mortar is placed from above to embed the resin-casting tube and fix the resin-casting tube to the concrete wall, a casting nozzle is attached to the resin-casting tube, a urethane type blowing resin is cast through the resin-casting tube, and the cast urethane type blowing resin is foamed on contact with water to intrude into the interiors of crack voids and into branched cracks and effect bonding and curing, whereby a water cutoff effect is attained.

In the conventional cutoff method in which a V-shaped notch is formed, the step of boring a V-shaped notch along the crack on the surface of a concrete wall by drilling, the step of inserting a resin-casting tube, and the step of placing a quick-setting cement are necessary, and a long time is required for completion of the operation. Accordingly, this conventional cutoff method is not suitable for a cutoff operation in a tunnel, which should be completed in a short time. Moreover, according to the conventional method, it is difficult to obtain a complete cutoff effect where the cracks are curved or where many cracks run from the main crack orthogonally thereto or at the periphery thereof.

SUMMARY OF THE INVENTION

Therefore, a primary object of the present invention is to solve the foregoing problems of the conventional method and provide a practical cutoff method and device for cracks in concrete structures, in which the operation time can be shortened, the operation can be performed very easily even if the main cracks are curved, and a cutoff effect can be simultaneously attained even for branched cracks and peripheral cracks.

The structure and function of the cutoff method of the present invention will now be summarized.

Many cutoff agent-sealing members having a predetermined open area and volume necessary for covering a crack from the outside are connected together and attached along the crack line of the surface of a concrete structure. A metal or plastic case member having a predetermined height or a case member formed of a thick rubber sheet or a metal sheet can be used as the cutoff agent-sealing member. Namely, it is sufficient if the cutoff agent-sealing member has predetermined open area and volume along the crack line and a structure capable of resisting a high pressure. The cutoff agent-sealing member should be provided with at least an opening for casting a cutoff agent. In general, a discharge opening for discharging water and air is arranged in addition to the casting opening.

When attaching the cutoff agent-sealing member to the surface of a concrete structure, the cutoff agent-sealing member is generally pressed and fixed to the concrete surface by an anchor bolt, so that the sealing member can resist a strong pressure, but other fixing methods can be adopted as long as the cutoff agent-sealing member can be tightly and easily attached.

After the many cutoff agent-sealing members are connected and attached along the main crack line of the concrete structure, a cutoff agent comprising a blowing resin, adhesive or the like is cast and filled in the interior of each cutoff agent-sealing member. The casting pressure or blowing pressure of the cutoff agent causes the pressure in the cutoff agent-sealing member to be raised and the cutoff agent intrudes not only into the main crack on the concrete surface covered by the cutoff agent-sealing member but also into deep portions of peripheral and branched cracks, whereby cracks can be blocked over a broad region. Furthermore, the cutoff agent is integrally attached in a predetermined thickness on the entire concrete surface covered by the cutoff agent-sealing member.

Accordingly, an inundation and a leakage of water from cracks of the concrete structure can be prevented.

Examples of the cutoff agent may include urethane type blowing resins and epoxy resins.

BRIEF DESCRIPTION OF THE DRAWINGS

FIG. 2*c* is a view similar to FIG. 2*b* after the case member has been filled with blowing resin;

FIG. 5*a* is a front view of a crack in a concrete surface which is to be repaired in accordance with the second embodiment after anchor bolts have been installed;

FIG. 5*b* is a front view of the surface of FIG. 5*a* after the case members according to the second embodiment have been mounted over the crack;

FIG. 6 is a top perspective view of a case member to be used in accordance with the second embodiment;

FIGS. 8*a*, 8*b*, 8*c*, 8*d* are views similar to FIGS. 2*a*, 2*b*, 2*c*', and 2*c*, respectively, of the third embodiment;

DESCRIPTION OF THE PREFERRED EMBODIMENTS

Figure 1A:
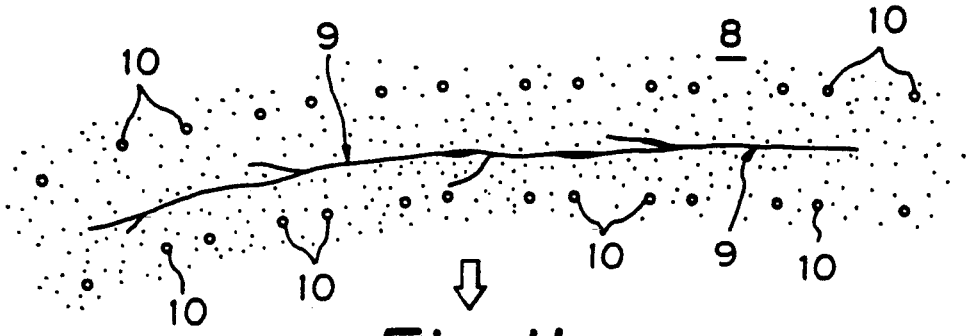
FIG. 1*a* is a front view of a crack in a concrete surface after anchor bolts have been installed on opposite sides of the crack.

The present invention will now be described in detail with reference to the embodiments illustrated in the accompanying drawings.

First Embodiment (FIGS. 1*a* through 3)

The first embodiment of the present invention is illustrated in FIGS. 1*a* through 3.

In this embodiment, a urethane type blowing resin such as that marketed under the tradename of TACSS or NL Paste is used as the cutoff agent 1, and a stainless steel case member 3 having a size of 250 mm×300 mm is used as the cutoff agent-sealing case member 2. Both the long side faces 4 projecting from an end plate 3*a* of the case member 3 are tapered to a shape broadening downward and bolt holes 5 are formed on the four corners of the top surface thereof. A cutoff agent-casting tube 6 provided with a short valve 13 and a discharge tube 7 provided with a valve 14 are attached to the top surface at two points. In the drawings, 8 represents the wall surface of a concrete structure, 9 represents a crack, 10 represents an anchor bolt, 11 represents a clamping nut for the case member 3, and 12 represents a packing.

Figure 1B:
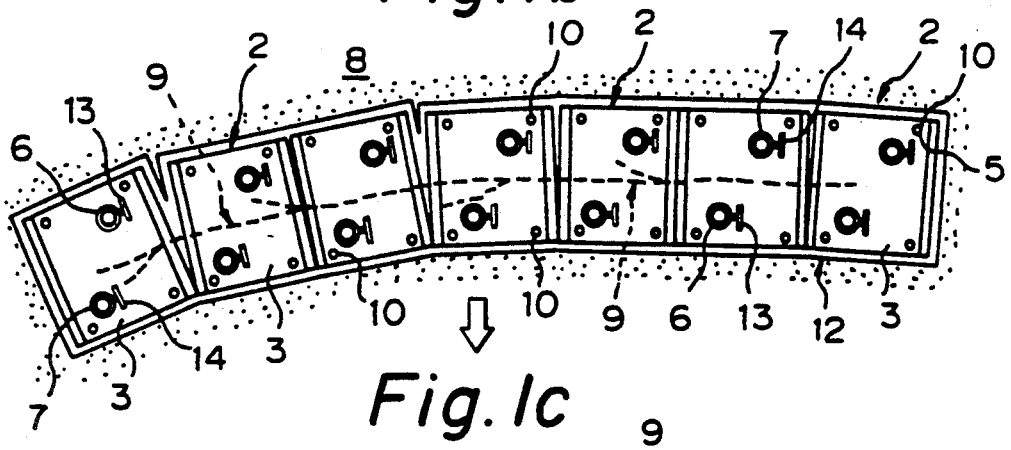
FIG. 1*b* is a front view of the concrete surface of FIG. 1*a* after case members according to a first embodiment of the invention have been mounted over the crack.
Figure 1C:
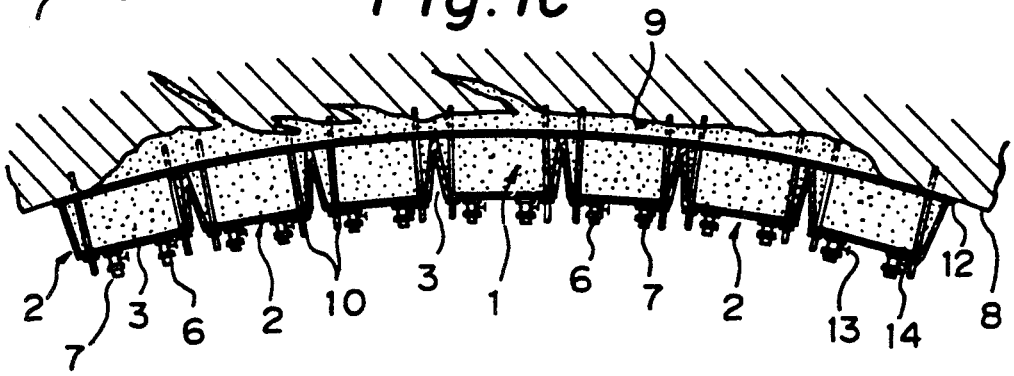
FIG. 1*c* is a longitudinal sectional view through the crack and case members of FIG. 1*b;*
Figures 2A, 2B, 2C:
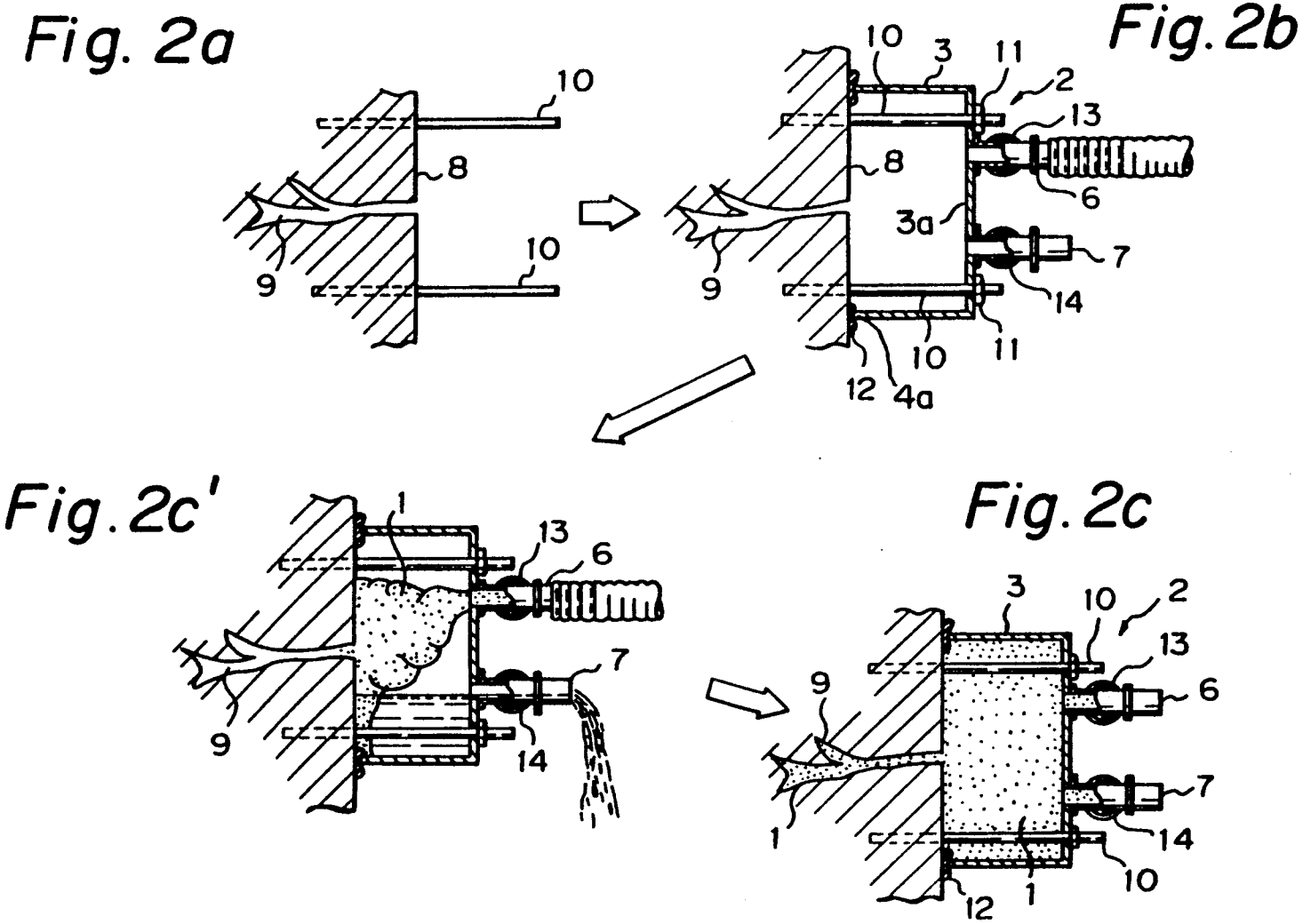
FIG. 2*a* is a cross-sectional view taken through the crack of FIG. 1*a;*
FIG. 2*b* is a cross-sectional view taken through a case member of FIG. 1*b;*
FIG. 2*c'* is a view similar to FIG. 2*b* as a blowing resin is being introduced into the case member.
Figure 3:
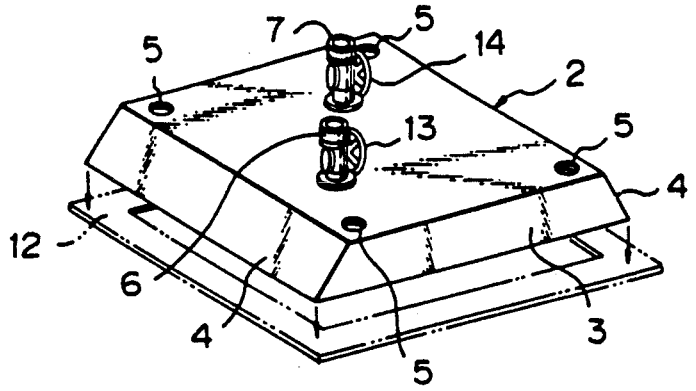
FIG. 3 is a top perspective view of a case member used in the first embodiment of the invention depicted in FIGS. 1–2*c;*
Figure 4A:
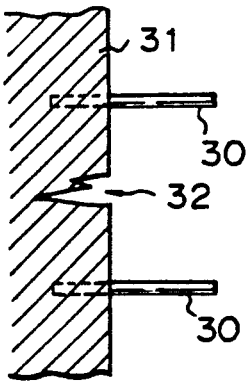
FIGS. 4*a*, 4*b*, 4*c* and 4*d* are views similar to FIGS. 2*a*, 2*b*, 2*c'* and 2*c*, respectively, of a second embodiment of the invention.
Figure 4D:
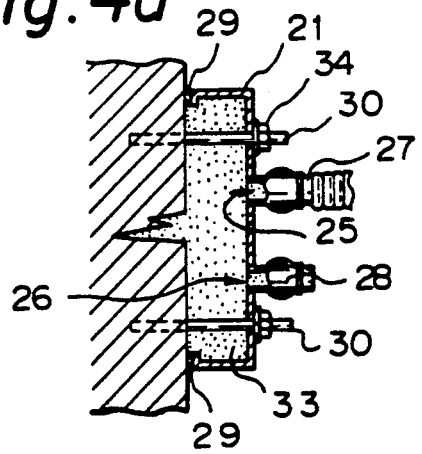
Figure 4B:
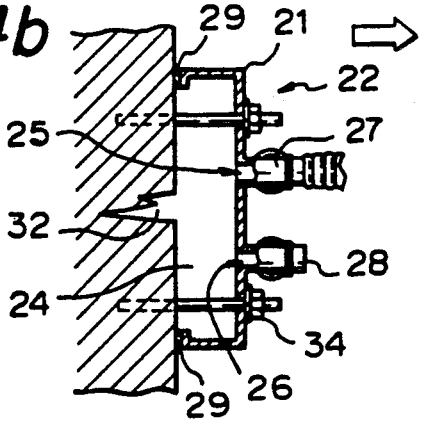
Figure 4C:
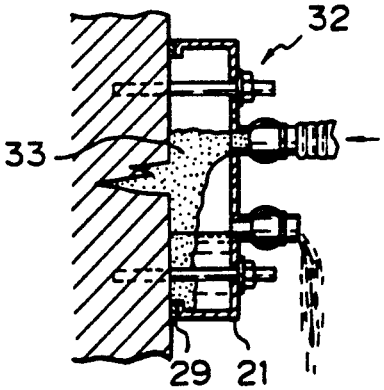
Figure 7A:
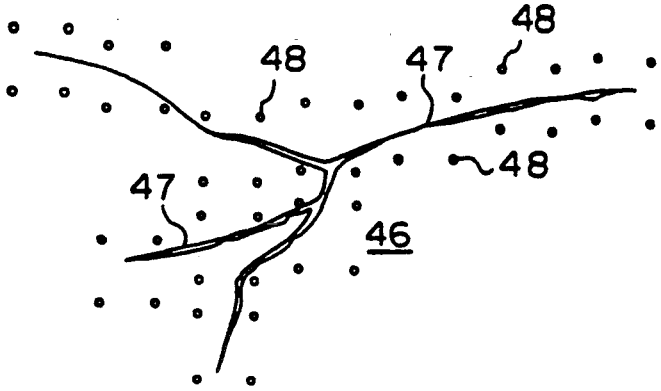
FIG. 7*a* is a front view of a crack in a concrete surface to be repaired in connection with a third embodiment of the invention after anchor bolts have been installed.
Figure 7B:
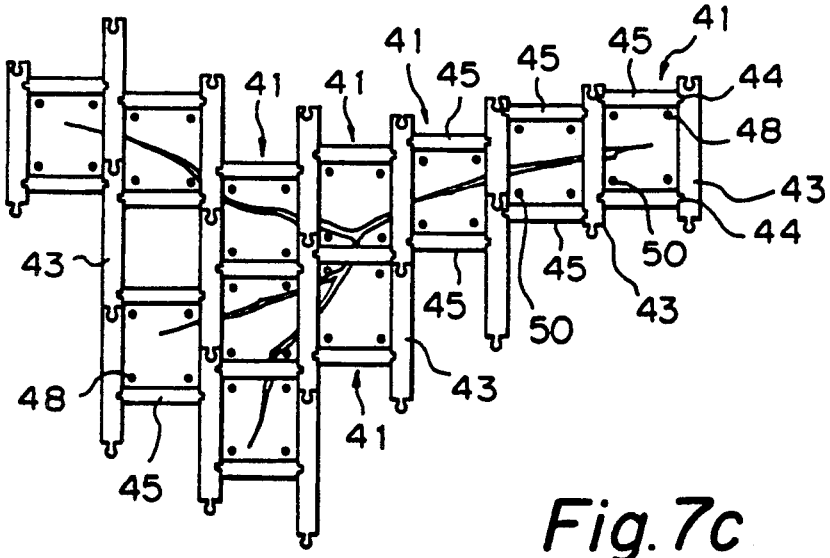
FIG. 7*b* is a front view of the surface of FIG. 7*a* after rubber sealing members according to the third embodiment have been secured around the crack.
Figure 7C:
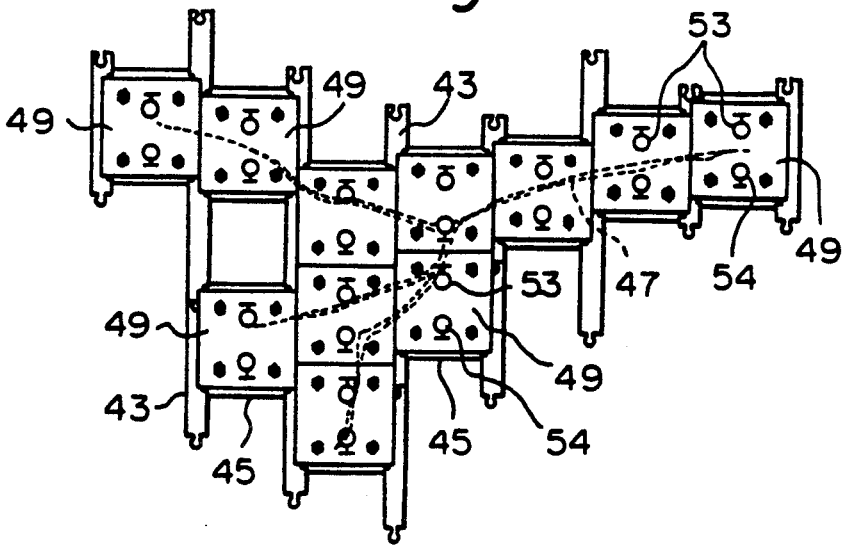
FIG. 7*c* is a view similar to FIG. 7*b* after case members according to the third embodiment have been mounted over the crack.
Figure 9:
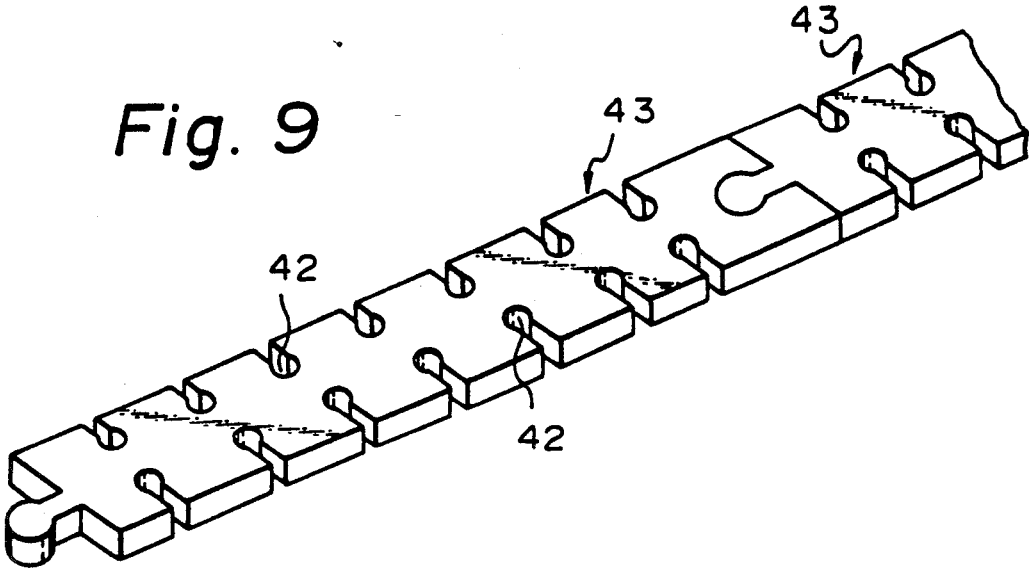
FIG. 9 is a perspective view illustrating a first rubber member used in the third embodiment of the present invention.
Figure 10:
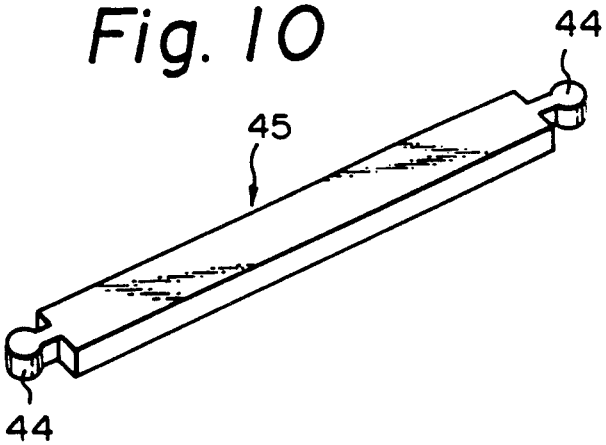
FIG. 10 is a perspective view illustrating a second rubber member used in the third embodiment of the present invention.

In the present embodiment, four anchor holes as one set are formed along and astride the main line of the crack 9, and the anchor bolts 10 are implanted in the holes see FIGS. 1(*a*) and 2(*a*).

The packing 12 having a rectangular shape is then spread and the cutoff agent-sealing case member 2 is arranged, the anchor bolts 10 are passed through the bolt holes 5, and the clamping nuts 11 are screwed to the anchor bolts 10 to fix the cutoff agent-sealing case member 2 in the compressed state to the wall surface 8 of the concrete structure. A plurality of such cutoff agent-sealing case members 2 are connected together and similarly fixed see FIGS. 1(*b*) and 2(*b*) .

Then, the valves 13 and 14 of the cutoff agent-casting tube 6 and discharge tube 7 are opened, and a urethane type blowing resin capable of an 8-fold expansion is introduced under pressure into the case member 3 from the cutoff agent-casting tube 6. The introduction of the resin under pressure causes water and air in the case member to be discharged from the discharge tube 7. After a sufficient discharge of water and air, the valve 14 of the discharge tube 7 is closed, and at this point, the case blowing agent capable of an 8-fold expansion is foamed and expanded, and the resulting expansion pressure causes the blowing resin to intrude into the entire opening of the crack on the wall surface of the concrete structure within the case member 3 and into the deep portions of branched cracks thereat. After completion of the casting, the valve 13 of the cutoff agent-casting tube 6 is closed, the interior of the case member is closed and sealed because of the engagement between surface opposing edges 4*a* of the side faces and the packing 12 on the wall surface, and the case member 3 remains tightly fixed to the wall surface of the concrete structure by the anchor bolts. Therefore, the blowing and expanding force acts to push the blowing resin into the crack 9.

Accordingly, the blowing resin is allowed to intrude into the deep portion of the crack 9 over the entire surface, and the resin is bonded and cured to fill voids in the concrete structure, whereby an inundation or a leakage of water from the crack is prevented.

The foregoing operation is conducted on all of the cutoff agent-sealing case members 2, and an inundation and a leakage of water from all of the cracks is thus prevented see FIGS. 1(*c*) and 2(*c*) .

After curing the blowing resin, the cutoff agent-sealing case members 2 may be left permanently as they are, or may be removed after completion of the operation. Even if the crack 9 is curved, since the case members 3 are connected to one another through side faces having a shape taperingly broadened downward, the operation efficiency is very good.

Second Embodiment (FIGS. 4*a* through 6)

The second embodiment of the present invention will now be described with reference to FIGS. 4*a* through 6.

In the present embodiment, a urethane type blowing resin is used as the cutoff agent, and a cutoff agent-sealing case member 22 which is partially indented arcuately is used as the flat-head case member 21 having a circular shape with respect to the plane.

In the drawings, 23 represents a peripheral concave recess which interrupts a convex periphery 23*a* of the cutoff agent-sealing case member 22, 24 represents an opening of the cutoff agent-sealing case member, 25 represents a cutoff agent-casting opening, 26 represents a discharge opening, 27 represents a valve-equipped cutoff agent-casting tube attached to the cutoff agent-casting opening 25, 28 represents a valve-equipped discharge tube attached to the discharge opening 26, 29 represents a rubber packing attached to the peripheral edge of the cutoff agent-sealing case member 22, 30 represents an anchor bolt, 31 represents a concrete wall, 32 represents a crack, 33 represents a blowing resin, 34 represents a clamping nut for the anchor bolt 30, and 35 represents a through hole for the anchor bolt 30.

In the present embodiment, first, many anchor bolts 30 are implanted along the crack line. When implanting the anchor bolts 30, the arrangement of the cutoff agent-sealing case members 22 is determined so that each sealing case member 22 blocks the crack 32 substantially at the center of the sealing case member 22, and the positions for implanting the anchor bolts 30 are determined according to the through holes 35 of the thus-determined arrangement of the cutoff agent-sealing case members 22. Then, the cutoff agent-sealing case member 22 is fitted to the concrete wall 31 having the crack 32, the anchor bolts 30 are inserted into the through holes 35, the anchor bolts 30 are clamped by the clamping nuts 34 to compress the rubber packing 29, and the cutoff agent-sealing case member 22 is fixed to the concrete wall 31. The adjacent cutoff agent-sealing case member 22 is then connected to the preceding cutoff agent-sealing case member 22 so that the convex periphery 23*a* of a case member 22 is fitted to the concave portion 23 of the preceding case member 22, and in the same manner as described above, the adjacent case member 22 is fixed in the compressed state to the concrete wall 31 by anchor bolts 30 and clamping nuts 34. By repeating the above operation, many cutoff agent-sealing case members 22 can be connected to one another along the crack line. If desired, branching cutoff agent-sealing case members 36 can be arranged to form a branched row of cutoff agent-sealing case members.

After a row of cutoff agent-sealing case members has been thus formed on the concrete wall 31, the blowing resin is introduced under pressure from the cutoff agent-casting tube 27 of the cutoff agent-sealing case member 22, and water and air in the cutoff agent-sealing case member 22 are discharged from the discharge tube 28 when the blowing resin 33 is introduced under pressure. When water and air are sufficiently discharged and the blowing resin 33 is filled in the inner space of the cutoff agent-sealing case member 22, the valve of the discharge tube 28 is closed. At this point, the blowing resin 33 introduced under pressure from the cutoff agent-casting tube 27 is sealed in the inner space of the case member 22 and the pressure is elevated, and therefore, the resin 33 is confined into the inner portion of the crack 32 under a high pressure, whereby the blowing resin is caused to intrude sufficiently into the deep portion of the crack 32 and branches thereof. After the blowing resin has been sufficiently cast, the valve of the cutoff agent-casting tube 27 is closed. By conducting this operation of casting the blowing resin under pressure on all of the cutoff agent-sealing case members, the blowing resin is caused to intrude into the deep portion, peripheral portion, and branched portion of the crack along the entire crack line, and by bonding and curing the blowing agent to the concrete wall surface, voids of the crack are filled and an inundation and a leakage of water is prevented.

In the present invention, the anchor bolts 30 may be collectively implanted. Alternatively, a method may be adopted in which, when one cutoff agent-sealing case member 22 is independently fixed to the concrete wall 31, the anchor bolts 30 are first implanted, the cutoff agent-sealing case member 22 is fixed to the implanted anchor bolts 30, and the anchor bolts of the subsequent cutoff agent-sealing case member 22 are implanted, and the subsequent cutoff agent-sealing case member 22 is fixed.

Note, the shape of the cutoff agent-sealing case member of the present invention is not limited to the shape adopted in the present embodiment.

Third Embodiment (FIGS. 7*a* through 10)

In the third embodiment illustrated in FIGS. 7*a* through 10, a packing grill 41 comprising a first rubber member 43 composed of a long rubber sheet having a thickness of 7 mm, in which keyhole-shaped fitting grooves 42 are disymetrically formed at intervals of 5 cm, and a second rubber member 45 composed of a short rubber sheet having a length of 20 cm, on both ends at which the keyhole-shaped fitting projections 44 are formed, is constructed, and the first rubber members 43 are laid out in parallel to one another and the fitting projections 44 of the second rubber members 45 are fitted into confronting keyhole-shaped fitting grooves 42 to connect these rubber members to one another and form rectangular grills.

In the drawings, 46 represents a concrete wall, 47 represents a crack, 48 represents an anchor bolt, 49 represents a flat stainless steel lid plate, 50 represents a through hole for the anchor bolt, formed in the lid plate, 51 represents a clamping nut, 52 represents a cutoff agent-casting opening, 53 represents a valve-equipped cutoff agent-casting tube, 54 represents a valve-equipped discharge tube for discharging water and air, and 55 represents a space for sealing the cutoff agent therein.

In the present embodiment, first, many anchor bolts 48 are implanted along the line of the crack 47 on the concrete wall surface 46. The anchor bolts 48 are implanted at positions corresponding to the through holes of the lid plate 49 to be attached.

Then, long first rubber members 43 are laid out in parallel to each other with a spacing of 20 cm, the second rubber members 45 are placed so that the crack 47 is located at the center, and the fitting projections 44 of the second rubber members 45 are fitted in the fitting grooves 42 of the first rubber members 43 to connect the rubber members to one another and form a rectangular packing grill 41 having a size of about 20 cm by about 25 cm. This packing grill 41 may be temporarily fixed by sticking, bonding or nailing. Alternatively, a method may be adopted in which the lid plate 49 is immediately pressed to the packing grill 41, the anchor bolts 48 are inserted into the through holes 50 of the lid plate 49, and the anchor bolts 48 are clamped by the clamping nuts 51 to fix the packing grill 41 to the concrete wall surface 46.

One or a plurality of packing grills 41 may be formed between confronting first rubber members 43.

In the above-mentioned manner, many packing grills 41 are continuously formed along the line of the crack 47, the formed packing grills 41 are pressed to the lid plate 49, the anchor bolts 48 are inserted into the through holes 50, the anchor bolts 48 are clamped by the clamping nuts 51, and the packing grills 41 are thus compressed to attach the packing grills 41 and lid plate 49 in the compressed state to the concrete wall surface 46.

Then, the discharge tube 54 attached to the lid plate 49 is opened, and in this state, a urethane type blowing resin such as that marketed under the tradename of TACSS is introduced under pressure from the cutoff agent-casting tube 53. The introduction of the cutoff agent under pressure causes water and air in the cutoff agent-sealing space to be discharged from the discharge tube 54. After the water and air have been sufficiently discharged, the valve of the discharge tube 54 is closed, whereby the cast blowing resin is foamed and expanded to fill the cutoff agent-sealed space. This expanding force causes the blowing resin to protrude deeply into the crack 47 of the concrete wall 46 and even into the deep and branched portions of the crack 47. After completion of the casting operation, the valve of the cutoff agent-casting tube 53 is closed. Since the cutoff agent-sealing space 55 is tightly fixed to the concrete wall 46 by the packing grill 41 and lid plate 49, leakage of the blowing resin does not occur.

Since the blowing resin is thus causes to intrude deeply into the crack 47 and is cured, an inundation and a leakage of water from the crack 47 is prevented.

By conducting the above operation on all of cutoff agent-sealing spaces 55, an inundation and a leakage of water can be prevented along the entire crack line on the concrete wall 46.

Figure 11:
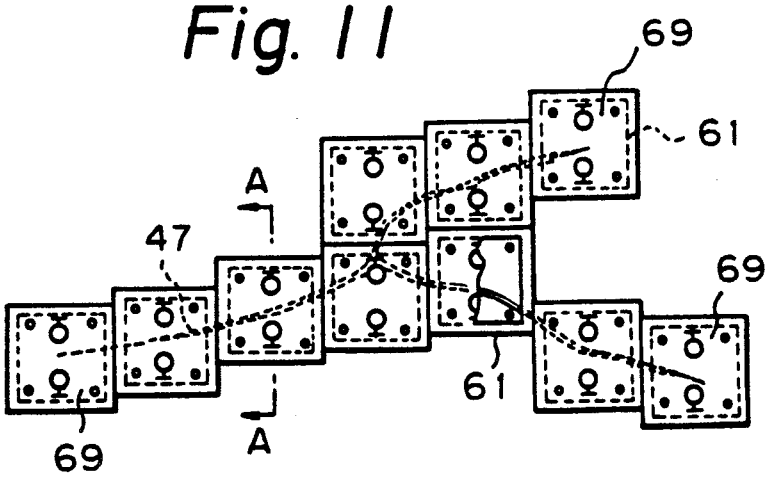
FIG. 11 is a plane view illustrating the fourth embodiment of the present invention.
Figure 12:
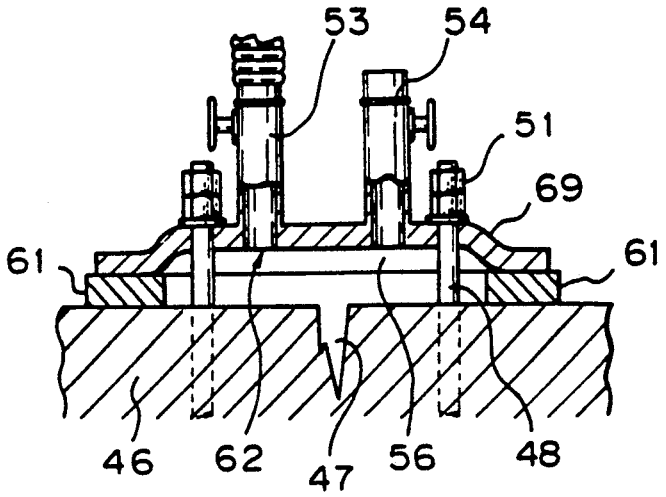
FIG. 12 is a view showing the section taken along the line A—A in FIG. 11.

Fourth Embodiments (FIGS. 11 and 12)

In the fourth embodiment shown in FIGS. 11 and 12, an integrally molded thick rectangular rubber sheet is used instead of the packing grill 41 of the third embodiment. More specifically, rectangular packing grills 61 are arranged astride a crack 47, and the packing grills 61 and lid plates 69 having a slightly bulged central portion are fixed in the compressed state to the concrete wall 46. The other features are the same as those of the third embodiment.

Figure 13:
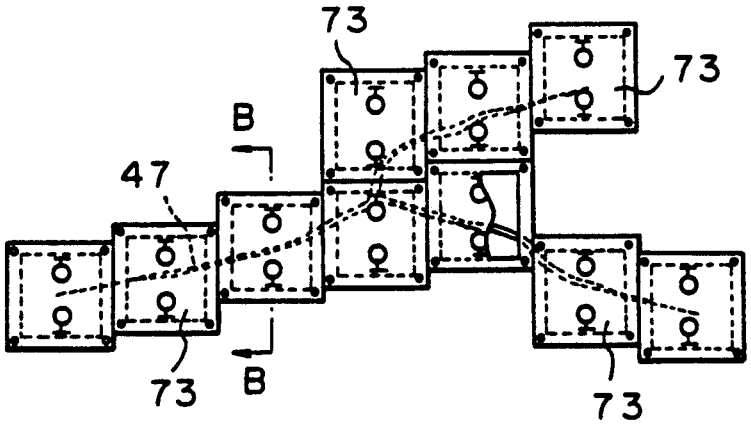
FIG. 13 is a plane diagram illustrating the fifth embodiment of the present invention.
Figure 14:
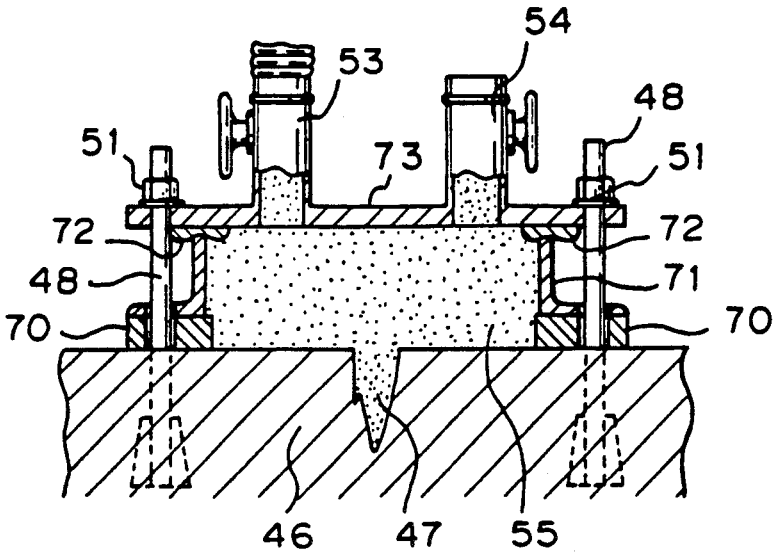
FIG. 14 is a view showing the section taken along the line B—B in FIG. 13.
Figure 15:
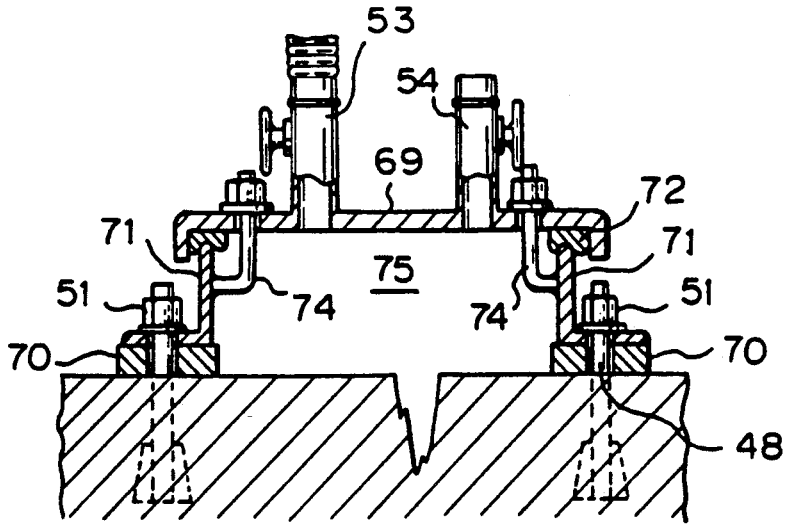
FIG. 15 is a sectional view illustrating another structure of the hard grill and lid plate in the fifth embodiment of the present invention.

Fifth Embodiment (FIGS. 13 through 15)

In the fifth embodiment illustrated in FIGS. 13 through 15, a cutoff agent-sealing space 55 is defined by a rectangular hard grill 71 of stainless steel having a rubber packing 70 attached to the lower end thereof, a lid plate 73 attached in the compressed state to the upper end of the hard grill 71 through a rubber packing 72, and a concrete wall 46. The lid plate 73 (or 69) and hard grill 71 together define a case member. A desired volume of the cutoff-sealing space 55 is maintained by the vertical wall portion of the hard grill 71. The hard grill 71 is fixed by anchor bolts 48 and the lid plate 73 is attached by a method in which the lid plate 73 is directly attached by the anchor bolts 48 as shown in FIG. 14, or a method in which the lid plate 73 is attached by other anchor bolts 74 attached to the grill 71 as shown in FIG. 15. The present embodiment is effective when maintenance of a large volume is desired by increasing the grill height. The other structural features and functions are the same as those of the fourth embodiment.

As is apparent from the foregoing description, according to the present invention, an inundation and a leakage of water from a crack formed in a concrete wall can be prevented merely by fixing a cutoff agent-sealing member and casting a cutoff agent, and therefore, the operation time can be drastically shortened. Furthermore, the cutoff agent can be caused to intrude deeply not only into a main crack but also into peripheral and branched cracks, and therefore, a complete cutoff effect can be attained. Moreover, even if the main crack line is bent or curved, since the cutoff agent is cast in the planar form, a cutoff effect can be easily attained.

I claim:

1. A method of repairing a continuous elongated crack in a concrete surface, comprising the steps of:

(a) overlying said crack along its entire length and width with a plurality of case members arranged in side-by-side relationship, each case member overlying less than said entire length of said crack and defining a chamber projecting outwardly of said surface and having a width greater than said width of said crack, each of said chambers having a predetermined open area and volume communicating with and covering said crack, (b) securing each of said case members individually to said surface by anchor bolts such that a seal which resists strong pressure is effected between said surface and respective surface-opposing edges of each of said case members, thereafter (c) introducing under pressure a urethane blowing agent through a valved inlet opening in each case member while a valved outlet opening in each respective case member is open, whereby said introduced blowing agent forces air and moisture outwardly through said valved outlet opening of each respective case member, thereafter (d) closing said valved outlet openings when said air and moisture have been sufficiently discharged from said crack and when said chambers of said respective case members are filled with said urethane blowing agent, (e) closing said valved inlet openings of said respective case members, and (f) allowing said urethane blowing agent to expand within said filled chambers and said crack, to thereby penetrate into said crack under the force of said expansion.

2. A method according to claim 1, wherein said overlying step includes placing said case members upon respective packing members disposed between said surface and said respective case members for effecting a seal between said surface and said surface-opposing edges of said case members.

3. A method according to claim 2, wherein said packing members are interconnected by groove-and-projection connecting portions of said packing members.

4. A method according to claim 1, wherein said overlying step comprises overlying said crack with case members each having a multi-sided surface-opposing edge such that adjacently disposed case members have a common side disposed in adjoining relationship.

5. A method according to claim 1, wherein said overlying step comprises overlying said crack with a plurality of case members each having a convexly curved surface-opposing edge interrupted by a concave recess which receives a convexly curved portion of a surface-opposing edge of an adjacently disposed case member.

6. A method according to claim 5, wherein said convexly curved and concavely curved portions constitute circular segments.

7. A method according to claim 1, wherein each said case member is assembled by attaching a lid plate to a grill member, said grill member carrying said surface-opposing edge.

* * * * *